United States Patent [19]

Souza et al.

[11] Patent Number: 5,011,036

[45] Date of Patent: Apr. 30, 1991

[54] FRONT LOADING, FOOT OPERATED REFUSE BIN

[76] Inventors: Dennis M. Souza, 1617 Carnelian Ct.; Tad E. Jakes, 505 Placer Dr., both of Woodland, Calif. 95695

[21] Appl. No.: 618,061

[22] Filed: Nov. 26, 1990

Related U.S. Application Data

[63] Continuation-in-part of Ser. No. 535,026, Jun. 8, 1990, abandoned.

[51] Int. Cl.[5] ..... B65D 43/26

[52] U.S. Cl. ..... 220/263; 220/908

[58] Field of Search ..... 220/263, 262, 264, 908

[56] References Cited

U.S. PATENT DOCUMENTS

| | | | |
|---|---|---|---|
| 1,938,013 | 12/1933 | Folsom et al. | 220/263 X |
| 2,308,326 | 1/1943 | Calcagno | 220/263 |
| 2,411,430 | 11/1946 | Hodson | 220/263 X |
| 2,615,663 | 10/1952 | Hamilton | 220/263 X |
| 2,634,074 | 4/1953 | Von Allmen | 220/263 X |
| 4,489,810 | 12/1984 | Curtis | 220/263 X |
| 4,771,940 | 9/1988 | Taylor | 220/335 |
| 4,785,964 | 11/1988 | Miller et al. | 220/263 |
| 4,892,218 | 1/1990 | Reiling | 220/263 |
| 4,913,308 | 4/1990 | Culbertson | 220/404 |
| 4,972,966 | 11/1990 | Craft, Jr. | 220/264 |

*Primary Examiner*—Stephen Marcus
*Assistant Examiner*—Vanessa M. Roberts
*Attorney, Agent, or Firm*—William S. Bernheim

[57] ABSTRACT

A front-end loading refuse bin providing a foot operable lid to allow two handed placement of trash in the bin.

5 Claims, 2 Drawing Sheets

FRONT LOADING, FOOT OPERATED REFUSE BIN

RELATED U.S. APPLICATION DATA

This application is a continuation-in-part of our application Ser. No. 07/535,026 filed June 8, 1990, now abandoned.

BACKGROUND OF THE INVENTION

1. Field of the Invention

The present invention relates to front loading refuse containers found at apartment and business complexes specially designed for mechanical lifting and emptying The invention further relates to modifying such bins to have a foot operable lid to allow two handed placement of trash in the bin and requiring no special precautions to avoid damage to the lid opening mechanism when the bin is lifted and emptied.

2. Description of the Prior Art

Heavy, sometimes wheel-mounted, refuse containers, which are lifted and emptied by lifting mechanisms of large refuse trucks, are very common. These containers are generally categorized into two primary groups, known in the industry as front-end loading (FEL) and rear-end loading (REL).

Front-end loading trucks are equipped with widely spaced forks mounted forward of the cab, and it is with these forks that the FEL container is lifted and inverted for emptying refuse into the truck.

In recent years, most apartment and business complexes have been provided with FEL refuse containers. The containers are too large and heavy for manual emptying. The forks on the truck are placed into sleeves constructed on the outside of each sidewall of the refuse container. It is with these forks that the container is lifted and inverted for emptying.

The containers are typically equipped with one or two plastic lids which are pivotally secured to the rear wall at the top, allowing them to be raised by hand for the placement of trash in the bin. This gives rise to a number of problems. Users of the containers find little benefit to the lids since it is awkward to hold the lid open with one hand and dump their trash with the other. The users frequently rotate the lids 270°, leaving them open. An open container not only causes obvious sanitary problems and noisome smells to the general public but also creates unwanted weight during rainy seasons which leads to added dumping fees or even financial overweight penalties for refuse contractors.

STATEMENT OF THE OBJECTS

Accordingly, it is a primary object of this invention to provide a lid apparatus for FEL refuse containers which is practical for the user and does not interfere with the emptying of the container.

A further object of this invention is to provide a front-end loading container with a counterweighted foot operated lid opening device to allow users to dispose of trash without rotating lids completely open.

It is still yet another object of the invention to incorporate a counterweight in the foot pedal of the lid apparatus. This assists in opening the lid and keeps the foot pedal and linkage in a stowed position during refuse container emptying by refuse trucks to prevent damage to foot pedal and linkage.

It is another object to provide a locking device which will allow lid(s) to be locked in an approximate 45° open position. This allows release of the foot pedal(s) for the disposal of large or numerous trash items.

It is yet another object of the invention to allow the container to be emptied by the refuse truck with the lids locked in the open position and, after being emptied, returned to the ground with lids in the closed position.

A further object of the invention is to incorporate a support device with the plastic lid to maintain rigidity and prevent twisting and sagging of the lid in hot weather.

Other objects, advantages and novel features of the invention will become apparent to those skilled in the art upon examination of the invention and the accompanying drawings.

SUMMARY OF THE INVENTION

BRIEF DESCRIPTION OF THE DRAWINGS

Further objectives and advantages of the invention will be apparent from the following detailed description, taken in conjunction with the accompanying drawings illustrating a preferred embodiment of the invention. The drawings are.

DETAILED DESCRIPTION OF A PREFERRED EMBODIMENT

Figure 1:
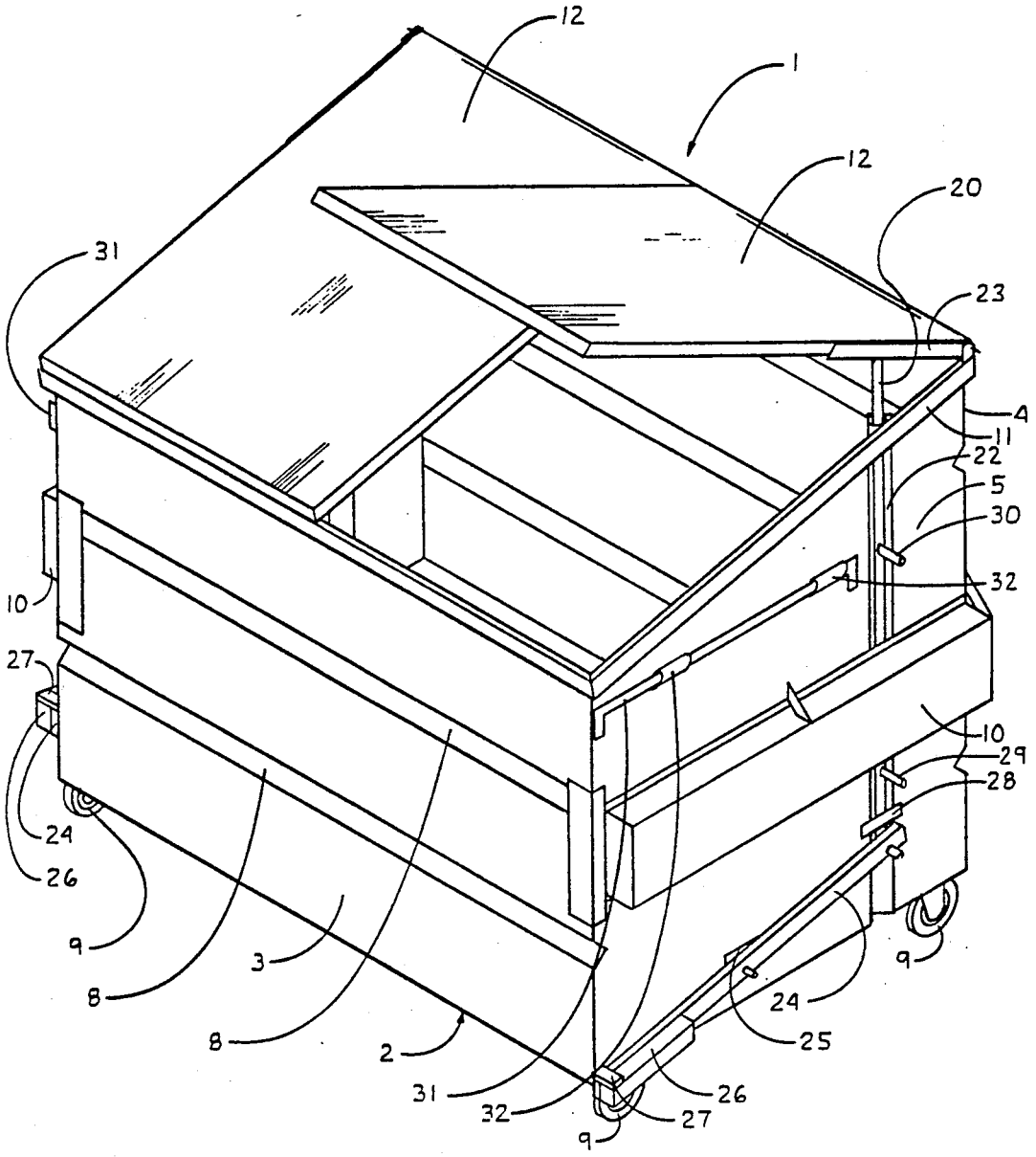
FIG. 1 is a prospective view of a FEL refuse bin according to the invention.
Figure 5:
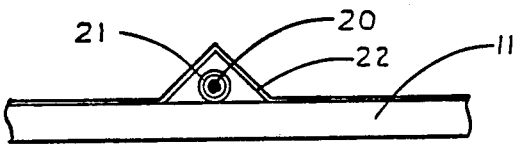
FIG. 5 is an enlarged partial plane view taken on viewing line 5—5 in FIG. 2.
Figure 4:
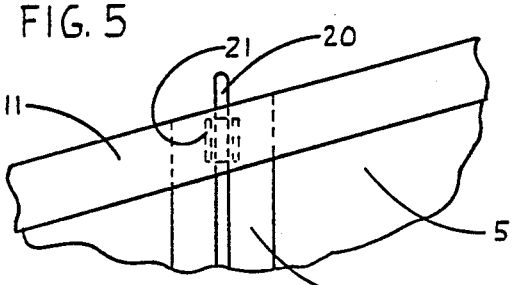
FIG. 4 is an enlarged partial elevation view taken of viewing line 4—4 in FIG. 3.
Figure 3:
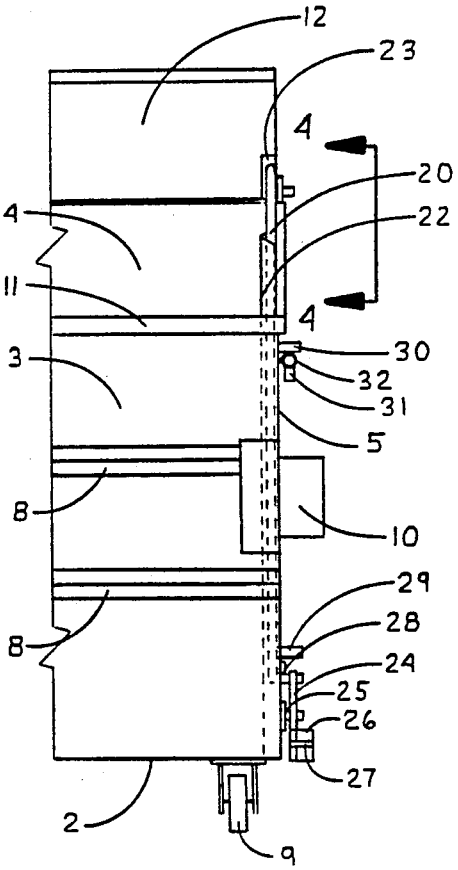
FIG. 3 is a partial front view of FIG. 1.
Figure 2:
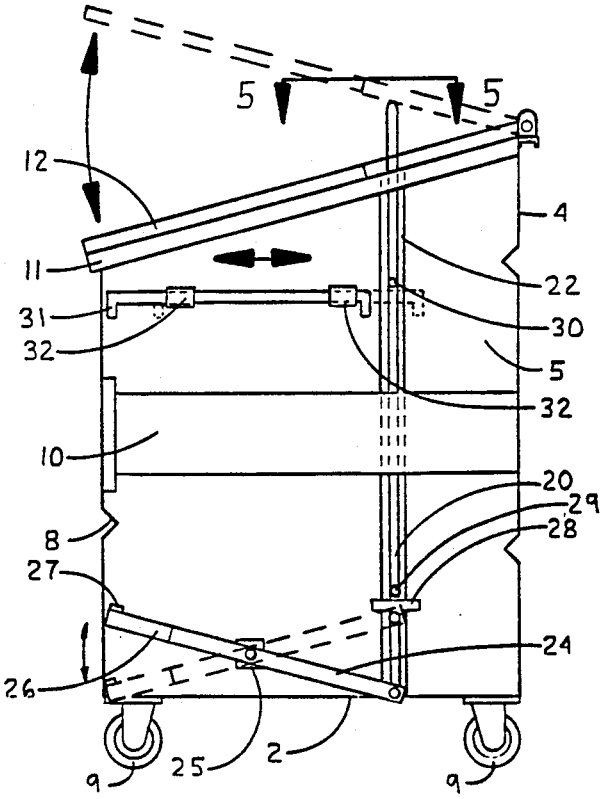
FIG. 2 is an end elevation view of FIG. 1. The dotted lines show lid open and the lock engaged.

A FEL refuse bin 1 is shown equipped with a separate foot operated lid apparatus on each side of the bin, in accordance with the invention. Each lid is operable independently. The refuse bin 1 has a floor 2, front wall 3, back wall 4, and side walls 5. Front wall 3 and back wall 4 are normally fabricated with corrugations 8 to add rigidity. Conventional caster wheels 9 are secured to the underside of floor 2. A lift sleeve 10 is attached to each side wall 5. These lift sleeves 10 allow the refuse bin 1 to be lifted and inverted for emptying by a conventional front-loading garbage truck. The upper edges of the front, rear, and side walls terminate in a reinforced perimeter 11. Lids 12 are rotably mounted to the rear portion of perimeter 11.

Along each side wall 5, a push rod 20, having a rounded upper end and lower end, travels vertically within the confines of a guide 21 and a channel 22. Each channel 22, formed in a side wall 5, and each guide 21 is positioned interior to perimeter 11 and lift sleeves 10 to allow push rod 20 to contact a support device 23 on underside of each lid 12. The support device 23, which is a strip of heavy plastic or other suitable material, is added to the outer edge of the lid to provide additional strength and minimize twisting and sagging of lid 12 during actuation of push rod 20. The lower end of each push rod 20 terminates in a right angle bend pivotally attached to a swing arm 24 and secured by any convenient means. Lock dogs 29 and 30, short pieces of rod, are affixed by welding to each push rod 20 and are provided to limit vertical travel of the push rod 20.

A swing arm 24, having a forward and rearward end, is pivotally secured to each side wall 5 by an attaching means 25 located near the lower central portion of the side wall 5. The forward end of the swing arm 24 terminates in a counterweight 26 and a pedal 27. Counterweight 26, a weight welded to swing arm 24, reduces the effort required to lift lid 12. The pedal 27 should be made nonskid and provides a suitable surface for an operator's foot during actuation of push rod 20. A stop 28, a rectangular strip of metal, is affixed by welding over the open face of each channel 22 to limit vertical travel of push rod 20 by interference with lock dog 29 and the lower end of the push rod 20. The width of the swing arm 24, attaching means 25, counterweight and pedal from the side wall 5 should be less then the width of the lift sleeve 10 so that outside surface of the lift sleeve 10 provides some protection from vertical obstacles.

Along each side wall 5, a lock rod 31 travels horizontally through lock guides 32 affixed by welding to side wall 5. Both lock rods 31 can be engaged to allow both lids 12 to remain in the open position, allowing access to the both sides of the refuse bin 1 at the same time. Each end of lock rod 31 terminates in a right angle bend. These ends serve as a stop to limit horizontal travel. The frontward lock guide 32 is located to allow lock rod 31 to travel under lock dog 30 when lid 12 is raised. The rearward lock guide 32 is located to prevent lock rod 31 from traveling past the forward edge of perimeter 11 when lock rod is retracted. Preventing the lock rod 31 from extending past the forward edge of the perimeter 11 is to avoid a safety hazard and to reduce the chance of the rod being bent.

In the trash receiving mode, the refuse bin 1 is operated by stepping on pedal 27, causing push rod 20 to travel vertically upward along the recessed channel 22 and within guide 21. The rounded upper edge of push rod 20 pushes up against support plate 23, causing the lid 12 to pivot upwards. Travel will stop when lock dog 29 contacts stop 28. At this point, the operator can keep his foot on the pedal 27 and use both hands to place trash in the trash bin 1, or lock rod 31 can be engaged. Lock rod 31 is engaged by pushing the lock rod rearward to the limit of travel. When the foot is removed from the pedal 27, the lock dog 30 contacts lock rod 31, and the lid 12 remains in the open position atop push rod 20. When lock rod 31 is disengaged and when the foot is removed from the pedal 27, the weight of the lid 12 and push rod 20 causes the counterweight to raise to its initial position and the lid 12 closes. Overtravel of push rod 20 is prevented by the interference of stop 28 and lock dog 29. For those overlooking the presence of the foot operated mechanism, the lightweight lids 12 can be operated directly by hand without interference by the foot operated mechanism. The lids 12 can also be rotated 270° by hand to a completely open position, if required, but the foot operated mechanism will not accomplish this task.

In the trash emptying mode, the refuse bin 1 is positioned in front of the front-loading garbage truck. It is not necessary to disengage lock rod 31. The truck with its forks engages the lift sleeves 10 and raises the refuse bin 1 overhead and starts the inversion motion. During the first 90° of rotation, gravity causes the lock rod 31 to disengage from lock dog 30 and drop toward the front of the trash bin 1 to the limit of travel. The lids 12, being free to rotate, start to swing open. During the second 90° of rotation, the push rod 20 is fully retracted into its closed position due to gravity acting on the counterweight causing rotation about the pivot point of attachment means 25. The lids 12 swing open to a vertical position and the trash falls into the garbage truck with no opportunity to damage the foot operated mechanism. When the trash bin 1 is righted, the lids 12 assume their normal closed position, and the foot operated mechanism is ready for operation with no resetting required.

If the trash bin 1 has to be moved to a different location, lift sleeves 10 and perimeter 11 prevent damage to the foot operated mechanism from most obstacles. Both foot operated mechanisms are inboard of the rugged lift sleeves 10 and perimeter 11 and cannot be damaged by collision with gate posts, walls, etc.

We claim:

1. A front-end loading refuse bin having a floor, a front wall, back wall and side walls forming a box, the walls having upper edges terminating in a reinforced perimeter, the bin having a lift sleeve on each side wall, and the bin having a lid apparatus comprising:

a. a lid rotatably mounted to the rear portion of the perimeter extending above a side wall, b. a support device on the underside of the lid adjacent the side wall, c. a channel formed in the side wall, interior to perimeter and lift sleeve, d. a push rod mounted to travel vertically within the channel and having a top end to contact the support device and having a stowed position in which the lid is closed and a open position in which the rod has been moved upward and the top has moved along the support device forcing an opening of the lid, and further the push rod having a bottom end pivotally attached to the rearward end of a swing arm, e. the swing arm is pivotally secured to the side wall by an attaching means located near the lower central portion of the side wall and having a pedal surface at the forward end of the swing arm,

2. The refuse bin of claim 1 further comprising a counterweight attached to the forward end of the swing arm so that when the bin is inverted the push rod remains in the stowed position or returns to the stowed position.

3. The refuse bin of claim 1 further comprising a lock rod mounted along the side wall to travel hoizontally between a first position in which the lock rod does not interact with the push rod and a second position in which the push rod is held so that in turn the lid is held in an open position.

4. The refuse bin of claim 3 wherein the lock rod retracts by action of gravity when the bin is inverted allowing the push rod to return to the stowed position to assure that when the bin is returned to the ground the lid is closed.

5. The refuse bin of claim 1 further comprising at least two stops to prevent the push rod from moving too high and preventing the push rod from moving too low.

* * * * *